US008833127B2

(12) United States Patent
Tomizawa et al.

(10) Patent No.: US 8,833,127 B2
(45) Date of Patent: Sep. 16, 2014

(54) HOLLOW MEMBER AND AN APPARATUS AND METHOD FOR ITS MANUFACTURE

(75) Inventors: Atsushi Tomizawa, Minoo (JP); Hiroaki Kubota, Nishinomiya (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 132 days.

(21) Appl. No.: 13/180,729

(22) Filed: Jul. 12, 2011

(65) Prior Publication Data

US 2012/0003496 A1 Jan. 5, 2012

Related U.S. Application Data

(63) Continuation of application No. PCT/JP2010/050277, filed on Jan. 13, 2010.

(30) Foreign Application Priority Data

Jan. 14, 2009 (JP) ..... 2009-005642

(51) Int. Cl.

| | |
|---|---|
| ***B21D 37/16*** | (2006.01) |
| ***B21C 37/15*** | (2006.01) |
| ***B21D 15/02*** | (2006.01) |
| ***B21D 5/08*** | (2006.01) |

(52) U.S. Cl.

CPC ..... *B21D 15/02* (2013.01); *B21C 37/155* (2013.01); *B21D 5/083* (2013.01)

USPC ..... 72/342.5; 72/128; 72/342.6; 72/367.1; 72/370.23

(58) Field of Classification Search

CPC ..... B21D 7/16; B21D 7/162; B21D 7/165; B21D 9/18; B21D 37/16

USPC ..... 72/128, 200, 201, 202, 206, 286, 288, 72/342.1, 342.2, 342.5, 342.6, 342.94, 72/367.1, 370.23, 370.24, 370.25, 364, 96, 72/100, 224, 225, 152, 159, 369, 31.06, 72/69, 368

See application file for complete search history.

(56) References Cited

U.S. PATENT DOCUMENTS 1,010,931 A * 12/1911 Maciejewski ..... 72/342.5
1,710,042 A * 4/1929 Bundy ..... 228/136

(Continued)

FOREIGN PATENT DOCUMENTS

DE 1393832 A1 * 3/2004 ..... B21D 7/025
GB 717605 * 10/1954 ..... B21D 7/00

(Continued)

OTHER PUBLICATIONS

Jidosha Gijutsu (Journal of Society of Automotive Engineers of Japan), vol. 57, No. 6 (2003), pp. 23-28.

*Primary Examiner* — Edward Tolan
(74) *Attorney, Agent, or Firm* — Clark & Brody

(57) ABSTRACT

A lightweight hollow member having a high strength such as at least 780 MPa, a complicated shape which can be applied to automotive parts, a high stiffness, and excellent impact properties, and a manufacturing apparatus and method which can form the hollow member by simple steps and which use relatively small and inexpensive forming equipment are provided. The manufacturing apparatus 10 has a feed unit 11 which feeds a hollow steel material being worked 20 having a closed transverse cross-sectional shape in its lengthwise direction, a support unit 12 which supports the material being worked 20 while it is being fed at a first position A, a heating unit 13 which heats the material being worked 20 at a second position B, a transverse cross-sectional shape modifying unit 14 which carries out working to modify the transverse cross-sectional shape of the material being worked 20 at a third position C, and a cooling unit 15 which cools the material being worked 20 at a fourth position D.

7 Claims, 6 Drawing Sheets

(56) References Cited

U.S. PATENT DOCUMENTS

| | | | | | |
|---|---|---|---|---|---|
| 1,891,338 | A | * | 12/1932 | Snell | 72/128 |
| 2,359,453 | A | * | 10/1944 | Waldron | 164/421 |
| 2,480,315 | A | * | 8/1949 | Bennett | 219/153 |
| 2,882,953 | A | * | 4/1959 | Huet | 72/159 |
| 3,229,489 | A | * | 1/1966 | Huet | 72/128 |
| 3,293,894 | A | * | 12/1966 | Edgecombe et al. | 72/42 |
| 3,368,377 | A | * | 2/1968 | Hirayama et al. | 72/128 |
| 3,403,541 | A | * | 10/1968 | Eisel | 72/201 |
| 3,902,344 | A | * | 9/1975 | Stuart | 72/128 |
| 4,048,834 | A | * | 9/1977 | Durbin et al. | 72/294 |
| 4,578,974 | A | * | 4/1986 | Pozsgay et al. | 72/97 |
| 4,821,551 | A | * | 4/1989 | Ogino et al. | 72/302 |
| 5,339,670 | A | * | 8/1994 | Granelli | 72/152 |
| 5,423,201 | A | * | 6/1995 | Steinmair et al. | 72/225 |
| 5,522,247 | A | * | 6/1996 | Mitsubayashi et al. | 72/302 |
| 5,713,130 | A | * | 2/1998 | Fukuda et al. | 29/897.3 |
| 5,802,903 | A | * | 9/1998 | Nakajima | 72/224 |
| 6,309,588 | B1 | * | 10/2001 | Powell et al. | 264/570 |
| 7,013,695 | B2 | * | 3/2006 | Quick et al. | 72/342.5 |
| 7,921,688 | B2 | * | 4/2011 | Wang et al. | 72/225 |

FOREIGN PATENT DOCUMENTS

| | | | | |
|---|---|---|---|---|
| JP | 59-206134 | * | 11/1984 | B21J 9/08 |
| JP | 4-162920 | * | 6/1992 | B21D 5/12 |
| JP | 31952083 | | 8/2001 | |
| JP | 3871416 | | 1/2007 | |
| JP | 2008-266694 | | 11/2008 | |
| WO | 2006/093006 | | 9/2006 | |

* cited by examiner

HOLLOW MEMBER AND AN APPARATUS AND METHOD FOR ITS MANUFACTURE

TECHNICAL FIELD

This invention relates to a hollow member and an apparatus and method for its manufacture. Specifically, the present invention relates to a lightweight hollow member having both a high stiffness and excellent impact properties and to an apparatus and method for manufacturing the hollow member.

BACKGROUND ART

Strength members, reinforcing members, and structural members made of metal are used in automobiles and various machines. These members are required to have properties such as a high strength, a light weight, and a compact size. From in the past, these members have been manufactured by various working methods such as welding of press-worked parts, and punching or forging of thick plates. It is extremely difficult to further decrease the weight and size of members produced by these manufacturing methods. For example, in order to manufacture a welded part by partially overlapping press-worked panels and welding them, it is necessary to form portions of excess thickness referred to as flanges on the edges of the press-worked panels. The weight of welded parts unavoidably increases due to forming the portions of excess thickness.

The working method referred to as hydroforming (see Non-Patent Document 1, for example) forms a tube into a complicated shape by introducing a high pressure working fluid into the interior of a tube (which is a material being worked) disposed inside a mold, and the tube is deformed by expansion so that the outer surface of the tube conforms to the inner surface of the mold. Parts having a complicated shape are integrally formed by hydroforming without the need to form a flange. In recent years, hydroforming has been actively used for the manufacture of automotive parts with the objective of reducing the weight of automotive parts.

Hydroforming is a type of cold working. A material being worked having a high strength such as at least 780 MPa has insufficient ductility in cold working. Therefore, forming this material into an automotive part having a complicated shape by hydroforming is difficult. In addition, the manufacturing process for hydroforming typically requires the three steps of bending, preforming, and hydroforming, which makes the process relatively complicated. Furthermore, a hydroforming machine is large and relatively expensive.

The present applicant previously disclosed a bending apparatus in Patent Document 1. FIG. 8 is an explanatory view schematically showing this bending apparatus 0.

The bending apparatus 0 manufactures a bent member from a metal material 1 by the following steps.

(a) The metal material 1 is supported by a support unit 2 so that it can move in its axial direction.

(b) The metal member 1 which is supported by the support unit 2 is fed by a feed unit 3 from the upstream side to the downstream side so that it can undergo bending by the following step (c) downstream of the support unit 2 while being fed.

(c) A portion of the metal member 1 is rapidly heated to a temperature at which quench hardening is possible by an induction heating coil 5 disposed downstream of the support unit 2. The metal member 1 is rapidly cooled by a water cooling unit 6 disposed immediately downstream of the induction heating coil 5. A movable roller die 4 has at least one set of roll pairs 4*a* which can support the metal member 1 while feeding it. The movable roller die 4 is disposed downstream of the water cooling unit 6. By two-dimensionally or three-dimensionally varying the position of the roll pairs 4*a*, a bending moment is imparted to the heated portion of the metal member 1.

The bending apparatus 0 can form an automotive part as a one-piece member having a high strength of at least 780 MPa by simple steps using a relatively inexpensive forming machine.

PRIOR ART DOCUMENTS

Patent Documents

Patent Document 1: WO 2006/093006

Non-Patent Documents

Non-Patent Document 1: Jidosha Gijutsu (Journal of Society of Automotive Engineers of Japan), Vol. 57, No. 6 (2003), pages 23-28

SUMMARY OF THE INVENTION

Problem Which the Invention is to Solve

The bending apparatus 0 is premised on manufacturing a part having a roughly constant cross-sectional shape in its lengthwise (axial) direction. As such, the shape of parts which can be manufactured by this bending apparatus is very limited. Thus, this bending apparatus 0 cannot manufacture a part having a complicated shape such as one having a cross-sectional shape which varies in its axial direction.

Means for Solving the Problem

The present invention is a manufacturing apparatus for a hollow member characterized by including the below-described feed unit, support unit, heating unit, transverse cross-sectional shape modifying unit, and cooling unit.

Feed unit: A unit having a mechanism for feeding a hollow metal material being worked in the lengthwise direction thereof, the material being worked having a closed transverse cross-sectional shape, Support unit: A unit having a mechanism which supports the material being worked which is being fed by the feed unit at a first position so that the material being worked can move, Heating unit: A unit having a mechanism which heats the material being worked at a second position downstream of the first position in the feed direction of the material being worked, Transverse cross-sectional shape modifying unit: A unit having a mechanism which carries out working for modifying the transverse cross-sectional shape of the material being worked at a third position downstream of the second position in the feed direction of the material being worked, and Cooling unit: A unit having a mechanism which cools the material being worked at a fourth position downstream of the third position in the feed direction of the material being worked.

In a manufacturing apparatus according to the present invention, the transverse cross-sectional shape modifying unit may be disposed so as to move two-dimensionally or three-dimensionally, and it may carry out bending of the material being worked by moving two-dimensionally or three-dimensionally. In this case, a manufacturing apparatus according to the present invention preferably further includes a deformation preventing unit which can prevent deformation of the material being worked by positioning the material being worked at a position downstream of the fourth position in the feed direction of the material being worked.

A manufacturing apparatus according to the present invention preferably has a gripping unit which is supported by an industrial robot, for example. The gripping unit preferably grips the material being worked downstream of the fourth position in the feed direction of the material being worked and is disposed so as to move two-dimensionally or three-dimensionally and carries out bending of the material being worked by moving two-dimensionally or three-dimensionally. When a manufacturing apparatus according to the present invention has a gripping unit, the transverse cross-sectional shape modifying unit is preferably fixed in place without moving.

In contrast to the above explanation, instead of using a cooling unit, the transverse cross-sectional shape modifying unit may have a mechanism for cooling the material being worked. In this case, the deformation preventing unit preferably prevents deformation of the material being worked by positioning the material being worked at a position downstream of the third position in the feed direction of the material being worked. In this case, the gripping unit preferably grips the material being worked downstream of the third position in the feed direction of the material being worked and is disposed so as to move two-dimensionally or three-dimensionally and carries out bending of the material being worked by moving two-dimensionally or three-dimensionally.

From another aspect, the present invention is a method of manufacturing a hollow member characterized by supporting a hollow metal material being worked having a closed transverse cross-sectional shape at a first position while feeding it in its lengthwise direction, heating the material being worked at a second position downstream of the first position in the feed direction of the material being worked, carrying out working to modify the transverse cross-sectional shape of the material being worked at a third position downstream of the second position in the feed direction of the material being worked, and cooling the material being worked at a fourth position downstream of the third position in the feed direction of the material being worked.

In a manufacturing method according to the present invention, instead of cooling the material being worked at the fourth position, the material being worked may be cooled at the third position.

In a manufacturing method according to the present invention, an example will be given of the case in which a material being worked undergoes two-dimensional or three-dimensional bending in position between the third position and the fourth position.

From another aspect, the present invention is a hollow member which is manufactured by the above-described manufacturing method according to the present invention and which has a hollow metal body which is constituted by a single piece in the lengthwise direction and has an closed transverse cross-sectional shape, characterized in that the body has at least a first region and a second region in its lengthwise direction, and the transverse cross-sectional shape of the body in the first region is different from the transverse cross-sectional shape of the body in the second region.

Effects of the Invention

According to the present invention, it is possible to provide a lightweight hollow member having a high strength such as at least 780 MPa, a complicated shape suitable for use in automotive parts, and a high stiffness and excellent impact properties, as well as a manufacturing apparatus and a manufacturing method which can manufacture this hollow member by simple steps and which use relatively small and inexpensive forming equipment.

EXPLANATION OF SYMBOLS

Figure 1:
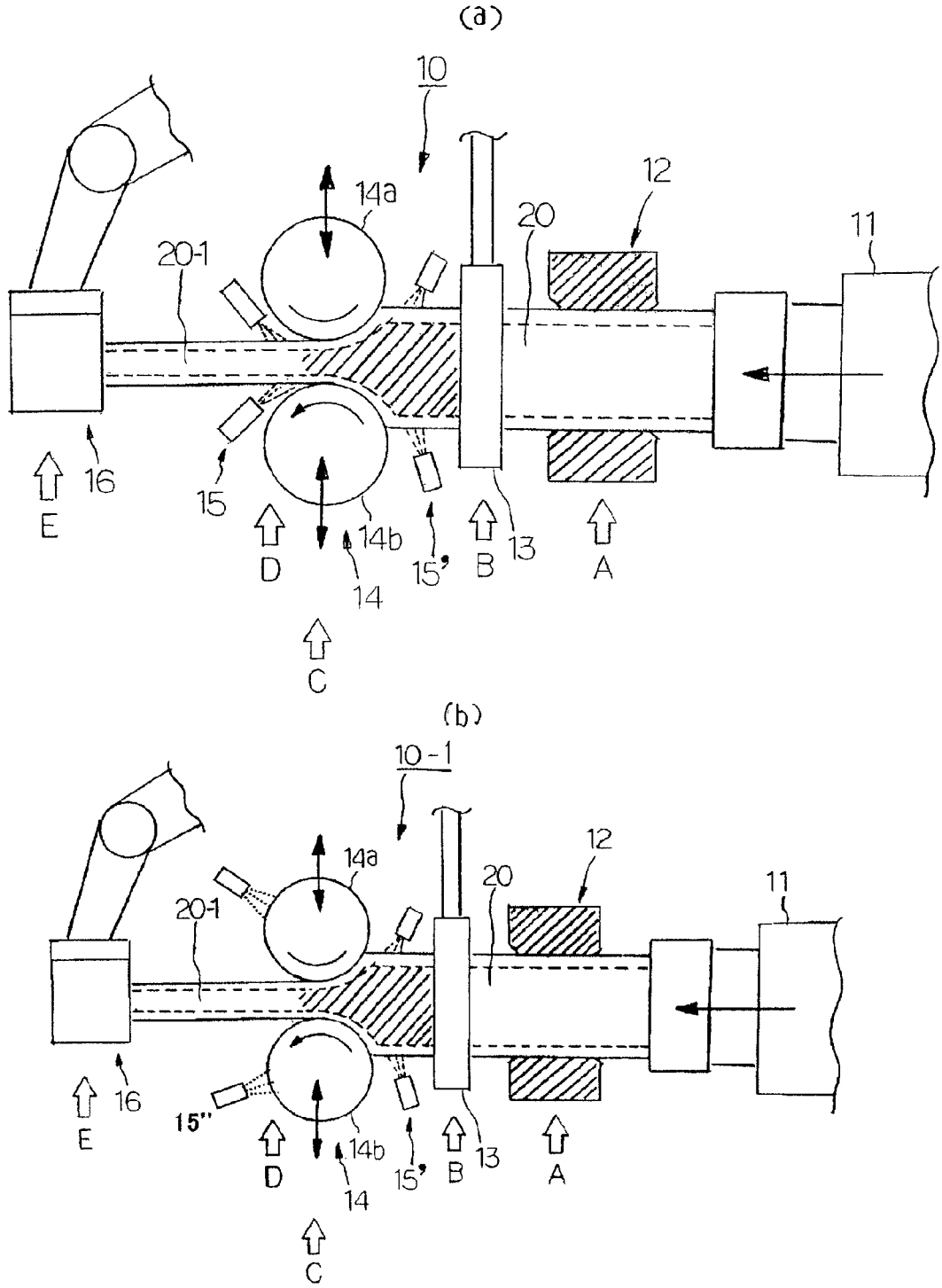
FIG. 1(*a*) and FIG. 1(*b*) are explanatory views schematically showing the structure of a manufacturing apparatus according to the present invention.

10, 10-1 manufacturing apparatus according to the present invention
11 feed unit
12 support unit
13 heating unit
14 transverse cross-sectional shape modifying unit
14*a* -14*d*, 14*a*-1 -14*d*-1*b* forming rolls
15, 15', 15" cooling units
16 deformation preventing unit
17 press
17*a* upper die
17*b* lower die
20 material being worked
20*b* vertical bead
20*c* side surface
20*a* vertical wall
20*d* depression
20-1 material for working after forming
22, 22*a*-22*c* hollow members
23*a*-23*c* body
24 first region
25 second region
A first position
B second position
C third position
E fourth position
E fifth position

MODES FOR CARRYING OUT THE INVENTION

Below, the best mode for carrying out the present invention will be explained.

FIG. 1(*a*) and FIG. 1(*b*) are explanatory views schematically showing the structure of manufacturing apparatuses 10 and 10-1 according to the present invention.

The manufacturing apparatus 10 shown in FIG. 1(*a*) includes a feed unit 11, a support unit 12, a heating unit 13, a transverse cross-sectional shape modifying unit 14, a cooling unit 15, and a deformation preventing unit 16. These components of the manufacturing apparatus 10 will be sequentially explained.

[Feed Unit 11]

The feed unit 11 is a unit having a mechanism for continuously or intermittently feeding the metal material being worked 20 in its lengthwise direction. The metal material being worked 20 is a hollow material having a closed transverse cross-sectional shape. The material being worked 20 is preferably made of steel, so in the following explanation, an example will be given of the case in which the material being worked 20 is made of steel. However, the material being worked 20 is not limited to steel, and the present invention can be applied in the same manner when the material being worked is a metal other than steel such as an aluminum alloy.

Examples of the material being worked 20 are straight materials having a closed cross section such as a seam welded steel pipe, a shape steel pipe obtained by roll forming of a seam welded steel pipe, and a material obtained by roll forming. However, the present invention is not limited to these materials, and the present invention can be applied to any hollow steel material having a closed transverse cross-sectional shape.

The feed unit 11 can be any feed unit of this type known to those skilled in the art (such as a ball screw), so a further explanation of the feed unit 11 will be omitted.

[Support Unit 12]

The support unit 12 is a unit having a mechanism which supports the material being worked 20, which is fed by the feed unit 11, at a first position A so that it can move. The support unit 12 can be any support unit of this type known to those skilled in the art, so a further explanation of the support unit 12 will be omitted.

[Heating Unit 13]

The heating unit 13 is a unit having a mechanism for heating the material being worked 20 at the second position B. The heating unit 13 preferably has the ability to rapidly heat the material being worked 20 to a temperature higher than or equal to the $Ac_3$ point of the material being worked 20, with an example of the heating unit being an induction heating device.

[Transverse Cross-Sectional Shape Modifying Unit 14]

The transverse cross-sectional shape modifying unit 14 is a unit having a mechanism for carrying out working which modifies the transverse cross-sectional shape of the material being worked 20 at a third position C.

The transverse cross-sectional shape modifying unit 14 is preferably disposed so as to be able to move three-dimensionally or two-dimensionally. Specifically, the transverse cross-sectional shape modifying unit 14 preferably has at least one pair of forming rolls 14*a* and 14*b*, and the at least one pair of forming rolls 14*a* and 14*b* is preferably disposed so as to be able to move three-dimensionally or two-dimensionally while feeding the material being worked 20. The at least one pair of forming rolls 14*a* and 14*b* preferably has the ability to reduce the material being worked 20, and it also preferably has a mechanism which rotatably drives the rolls.

Figure 2:
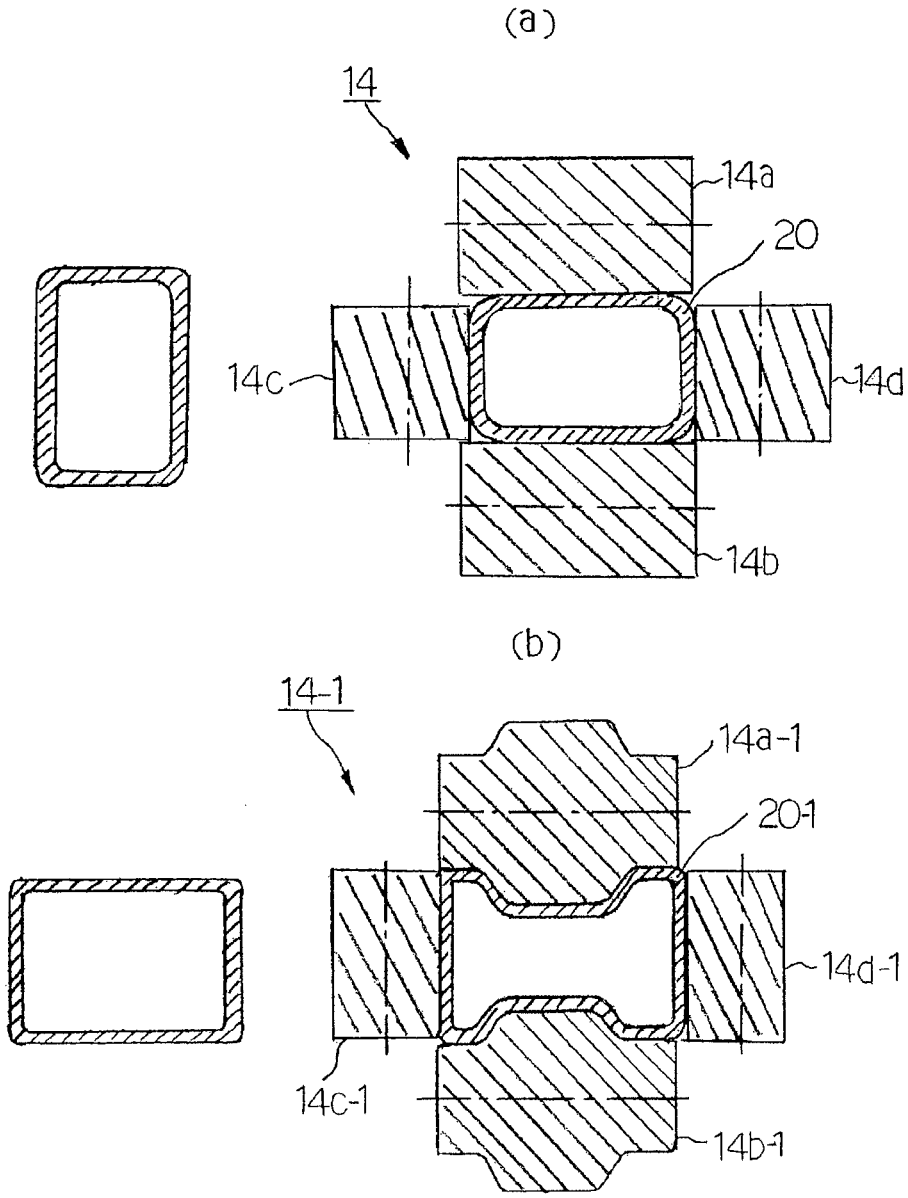
FIG. 2(*a*) and FIG. 2(*b*) are explanatory views showing examples of the structure of a plurality of forming rolls which constitute a transverse cross-sectional modifying unit.

FIG. 2(*a*) and FIG. 2(*b*) are explanatory views showing an example of the structure of a plurality of forming rolls which constitute the transverse cross-sectional shape modifying unit 14.

FIG. 2(*a*) shows the case in which at least one pair of forming rolls 14 comprises one pair of horizontal rolls 14*a* and 14*b* and one pair of vertical rolls 14*c* and 14*d*. FIG. 2(*b*) shows the case in which at least one pair of forming rolls 14-1 comprises one pair of horizontal rolls 14*a*-1 and 14*b*-1 and one pair of vertical rolls 14*c*-1 and 14*d*-1.

As shown in FIG. 2(*a*), the forming rolls 14*a* to 14*d* may be straight rolls, or as shown in FIG. 2(*b*), the forming rolls 14*a*-1 to 14*d*-1 may be shape rolls such as grooved rolls.

Figure 3:
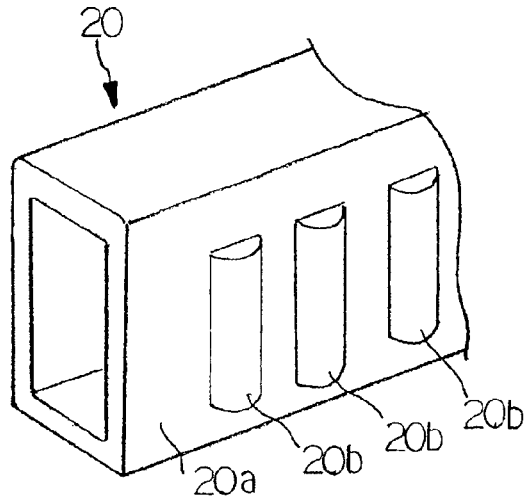
FIG. 3 is an explanatory view showing one example of a preferred material being worked for use when carrying out the forming process shown in FIG. 2(*b*).

FIG. 3 is an explanatory view showing one example of a material being worked 20 which is preferably used for carrying out the forming process shown in FIG. 2(*b*).

As shown in FIG. 3, when carrying out the forming process shown in FIG. 2(*b*), vertical beads 20*b* are preferably provided in the vertical walls 20*a* of the material being worked 20 (the portions which are shaped by grooved rolls). The strength of the vertical walls 20 is increased by providing the vertical beads 20*b*, whereby a good product is manufactured.

Figure 4:
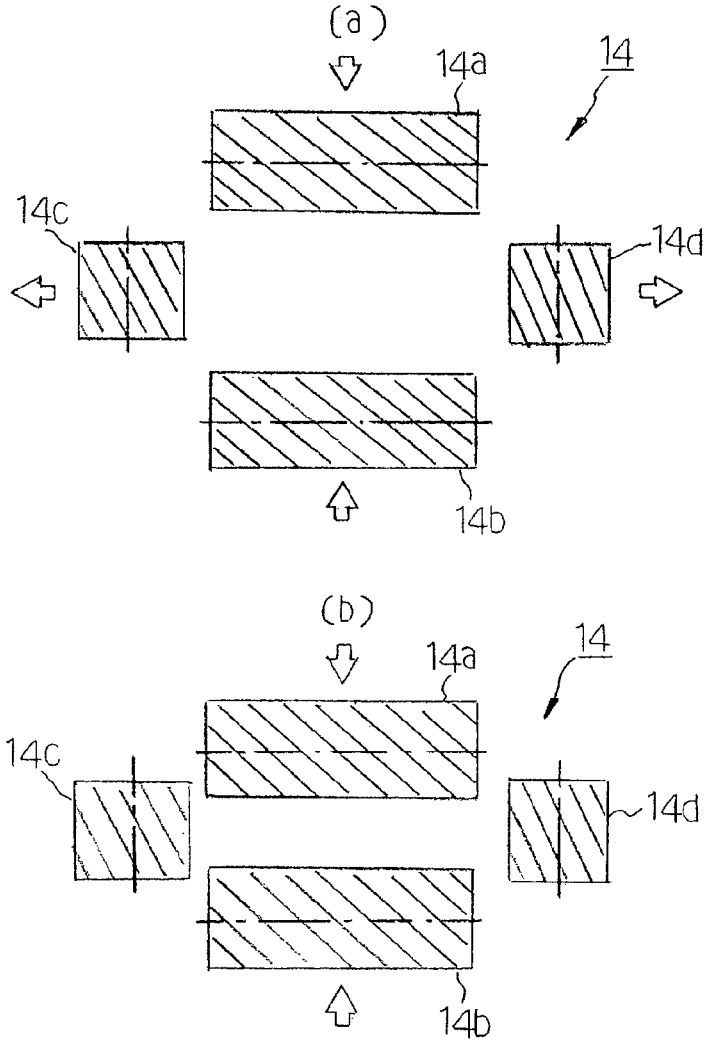
FIG. 4(*a*) and FIG. 4(*b*) are explanatory views schematically showing control of the forming rolls shown in FIG. 2(*a*).

FIG. 4(*a*) and FIG. 4(*b*) are explanatory views schematically showing the way of controlling the positions of the forming rolls 14*a*-14*d* shown in FIG. 2(*a*).

As shown in FIG. 4(*a*) and FIG. 4(*b*), the positions of the pair of horizontal rolls 14*a* -14*d* can more preferably be controlled independently from the positions of the pair of vertical rolls 14*c* and 14*d*. As shown in FIG. 4(*a*), the gap between vertical rolls 14*c* and 14*d* can be adjusted while reducing in the vertical direction and adjusting the width in the horizontal direction with respect to the material being worked 20, so the width of a formed product can be changed. Alternatively, as shown in FIG. 4(*b*), the gap between the vertical rolls 14*c* and 14*d* can be maintained constant while reducing in the vertical direction and adjusting the width in the horizontal direction with respect to the material being worked 20.

Figure 5:
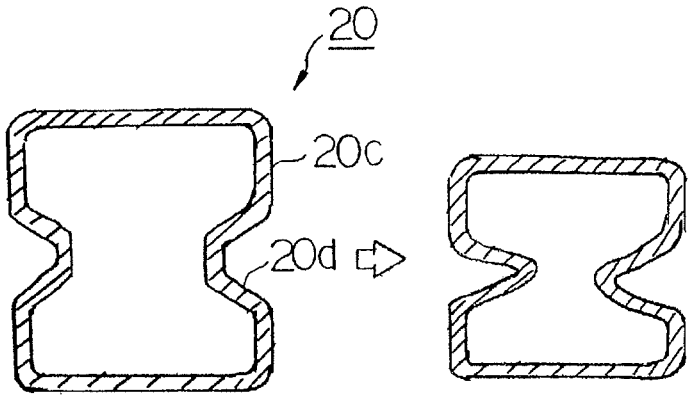
FIG. 5 is an explanatory view showing an example of a preferred material being worked for use when carrying out the forming process shown in FIG. 4(*b*).

FIG. 5 is an explanatory view showing an example of a preferred material being worked 20 which is used when carrying out the forming process shown in FIG. 4(*b*).

As shown in FIG. 5, the forming process shown in FIG. 4(*b*) can be smoothly carried out by providing depressions 20*d* in the side surfaces 20*c* of the material being worked 20.

Preferably at least one of the forming rolls 14*a* -14*d* and 14*a*-1-14*d*-1 is a grooved roll, depending upon the amount of modification of the transverse cross-sectional shape of the material being worked 20.

Figure 6:
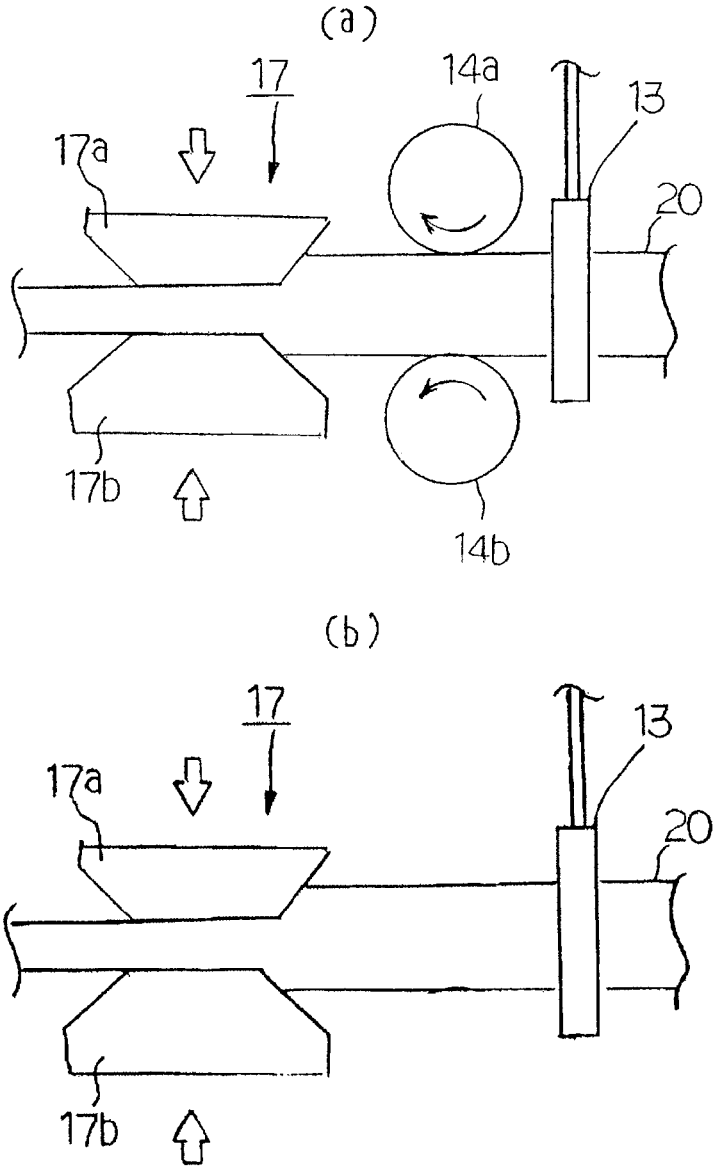
FIG. 6(*a*) and FIG. 6(*b*) are explanatory views schematically showing another example of a transverse cross-sectional shape modifying unit.

FIG. 6(*a*) and FIG. 6(*b*) are explanatory views schematically showing another example of a transverse cross-sectional shape modifying unit 17.

As shown in these figures, the transverse cross-sectional shape modifying unit 17 is constituted by a press having an upper die 17*a* and a lower die 17*b*. The press is disposed downstream of the at least one pair of rolls 14*a* and 14*b* in the feed direction of the material being worked 20. This transverse cross-sectional shape modifying unit 17 is used when the at least one pair of rolls 14*a* and 14*b* do not have the ability to reduce a heated material being worked 20. The unit has a mechanism for reducing a material being worked 20 which was heated by the heating unit 13.

The transverse cross-sectional shape of the material being worked 20 is modified even when the at least one pair of rolls 14*a* and 14*b* does not have the ability to reduce a heated material being worked 20 by providing the transverse cross-sectional shape modifying unit 17.

It is also possible to provide a press even when the at least one pair of rolls 14*a* and 14*b* have the ability to reduce a heated material being worked 20. In this case, the transverse cross-sectional shape modifying unit is constituted by a pair of rolls 14*a* and 14*b* as well as a press. As a result, the extent of modification of the transverse cross-sectional shape of the material being worked 20 is increased.

As shown in FIG. 6(*b*), the pair of rolls 14*a* and 14*b* may be omitted when bending of the material being worked 20 is carried out by the below-described gripping unit.

[Cooling Unit 15]

The cooling unit 15 is a unit having a mechanism for cooling the material being worked 20 at a fourth position D. An example of the cooling unit 15 is a water cooling apparatus.

When the transverse cross-sectional shape of the material being worked is not modified by the above-described transverse cross-sectional shape modifying unit 14, as shown in FIG. 1, a cooling unit 15' disposed between the heating unit 13 and the transverse cross-sectional shape modifying unit 14 may cool the heated material being worked 20 instead of a cooling unit 15 provided downstream of the transverse cross-sectional modifying unit 14.

As shown in FIG. 1(*b*), instead of using the cooling unit 15 disposed at the fourth position D, the transverse cross-sectional shape modifying unit 14 may have a mechanism which cools the material being worked 20. The pair of rolls 14*a* and 14*b* modifies the transverse cross-sectional shape of the material being worked 20 and at the same time carries out cooling of the heated material being worked 20. In this case, since the pair of rolls 14*a* and 14*b* is heated, a cooling unit 15" is preferably provided for cooling the pair of rolls 14*a* and 14*b*.

[Deformation Preventing Unit or Gripping Unit 16]

The deformation preventing unit 16 is a unit having a mechanism which prevents deformation of the material being worked 20 by positioning the formed member 20-1 at a fifth position E downstream of the fourth position D in the feed direction of the material being worked 20. The manufacturing apparatus 10 does not always need include the deformation preventing unit 16.

A specific examples of the deformation preventing unit 16 is a device which supports and guides the front end of the material being worked 20 or a deformation preventing table on which the material being worked 20 rests and which prevents deformation of the material due to its weight.

The deformation preventing unit 16 may be constituted by a known articulated robot. By suitably adjusting the feed speed (the operating speed) of the robot and thereby controlling the pulling speed of the formed material 20-1, driving of the pair of rolls 14*a* and 14*b* can be omitted, and the tensile stresses or compressive stresses produced in the worked portion of the formed material 20-1 can be controlled.

Instead of the deformation preventing unit 16, it is possible to provide a gripping unit which is supported by an industrial robot, for example.

A gripping unit may (a) grip the material being worked 20 downstream of the fourth position D in the feed direction of the material being worked 20, (b) it may be disposed so as to move two-dimensionally or three-dimensionally, and (c) it may bend the material being worked 20 by moving two-dimensionally or three-dimensionally. When the manufacturing apparatus 10 has a gripping unit, the gripping unit carries out bending of the material being worked 20. Therefore, the transverse cross-sectional shape modifying unit 14 is preferably installed in a fixed position from the standpoints of ease of control and preventing the range of movement of the gripping unit from increasing.

The manufacturing apparatus 10 is constituted as described above. Next, the state when manufacturing a hollow member by the manufacturing apparatus 10 will be explained.

First, the feed unit 11 continuously or intermittently feeds a hollow steel material being worked 20 having a closed transverse cross-sectional shape in its lengthwise direction.

At the first position A, the support unit 12 supports the material being worked 20 which is fed by the feed unit 11.

The heating unit 13 rapidly heats the material being worked 20 at the second position B to at least the $Ac_3$ point.

At the third position C, the transverse cross-sectional shape modifying unit 14 carries out working which modifies the transverse cross-sectional shape of the material being worked 20 which had its resistance to deformation greatly decreased by the rapid heating.

The cooling unit 15 then rapidly cools the material being worked 20 at the fourth position D.

A hollow member according to the present invention is manufactured in this manner.

Preferably, the deformation preventing unit 16 prevents deformation of the material being worked 20 by positioning the formed material 20-1 at the fifth position E. As a result, a decrease in the dimensional accuracy of the manufactured hollow member can be suppressed.

When the transverse cross-sectional shape modifying unit 14 does not carry out reduction of a material being worked 20, it is possible to carry out the working method disclosed in Patent Document 1 by stopping supply of cooling water from the cooling unit 15 and carrying out cooling from the cooling unit 15' provided on the exit side of the heating unit 13.

The heated portion of the material being worked 20 can be placed into a state of tensile stress or compressive stress by suitably controlling the feed speed of the material worked 20, the rotational speed of the forming rolls 14*a* and 14*b*, and the speed of movement of the front end clamp for the material being worked 20 by the deformation preventing unit 16. Therefore, problems occurring during forming can be suppressed by applying a tensile stress to the material being worked 20 when wrinkles easily develop in the material being worked 20 or applying a compressive stress when a decrease in wall thickness is a problem.

For example, by suitably modifying the feed speed of the material being worked 20 on the entrance side of the first position A and/or the speed of movement of the material being worked 20 at the third position C, a tensile stress is applied to the portion of the material being worked 20 from the second position B to the third position. As a result, the cross-sectional area of the material being worked 20 is decreased. Conversely, by imparting a compressive stress to the portion of the material being worked 20 from the second position B to the third position, the cross-sectional area of the material being worked 20 is increased.

Namely, by having the rotational speed of the pair of rolls 14*a* and 14*b* be higher than the feed speed of the material being worked 20 by the feed unit 11, a tensile stress is applied to the heated portion of the material being worked 20. As a result, the width or height or wall thickness of the formed material 20-1 is decreased. Conversely, by making the rotational speed of the pair of rolls 14*a* and 14*b* lower than the feed speed of the material being worked 20 by the feed unit 11, a compressive stress acts on the heated portion of the material being worked 20. As a result, the width or height or wall thickness of the formed material 20-1 is increased.

In this manner, a product having a shape such that the dimension of the circumference of a cross section varies in the lengthwise direction can be formed.

In the above explanation, an example was given of the case in which heating of the material being worked 20 by the heating unit 13 is carried out over the entire length of the material being worked 20. However, partial heating in the lengthwise direction of the material being worked 20 is possible by using an induction heating device, for example, as the heating unit 13. In this case, not only the heated portion but also unheated portions may be worked by the transverse cross-sectional shape modifying unit 14. Namely, at the second position B, the material being worked 20 is heated in portions of its length, and at least some of the portions which are not heated at the second position B are worked so as to modify their transverse cross-sectional shape at the third position C. As a result, it is possible to perform in-line working of the unheated portions without carrying out shaping by after-processing of the unheated portions in a separate line, so processing can be shortened and the working accuracy can be increased.

Figure 7:
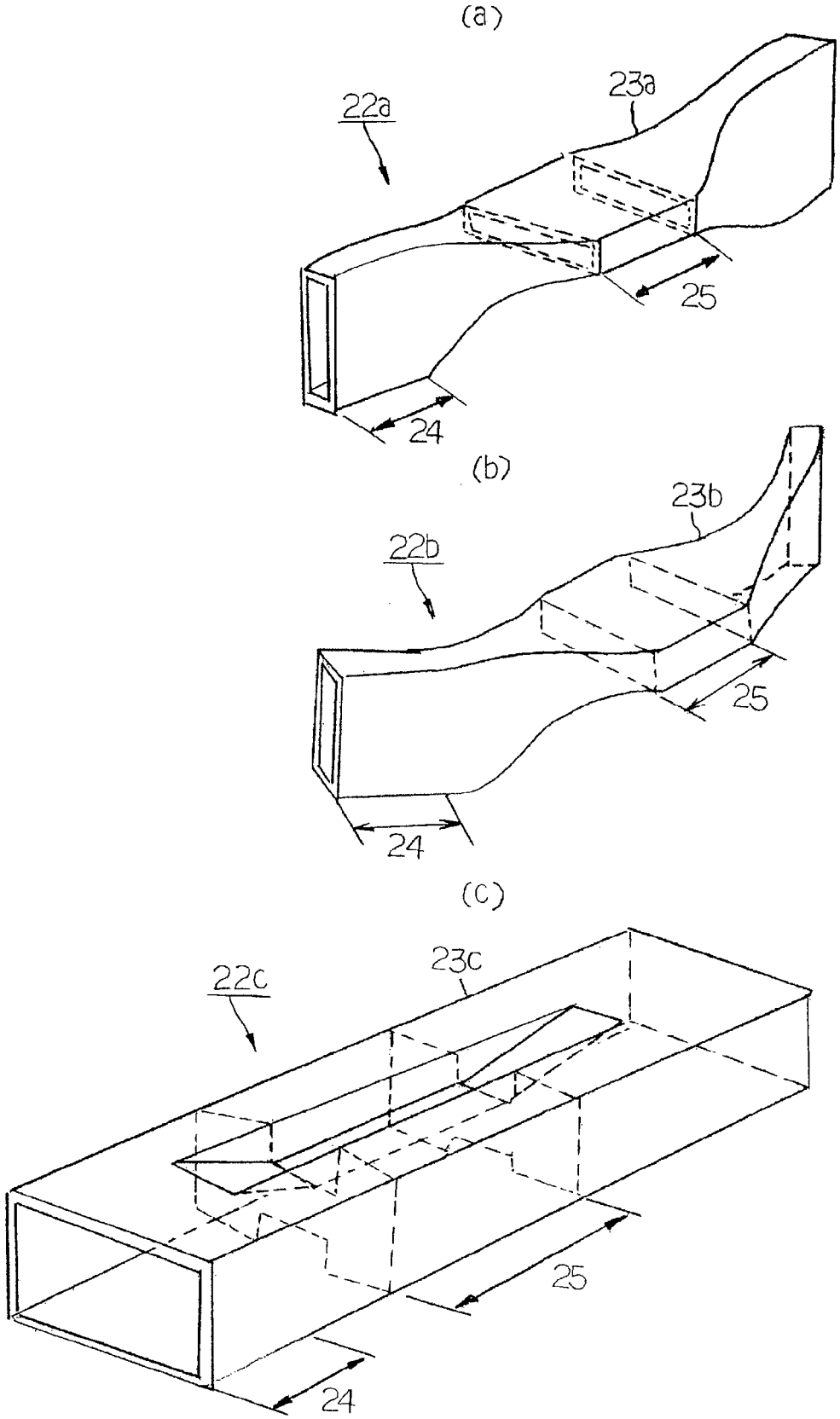
FIG. 7(*a*)-FIG. 7(*c*) are explanatory views showing examples of hollow members according to the present invention.
Figure 8:
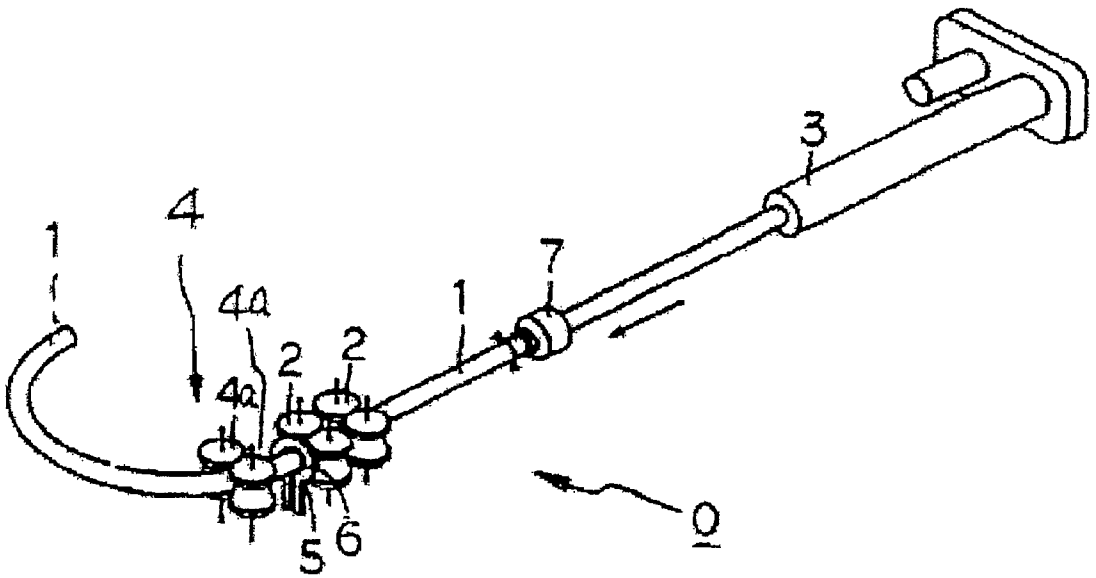
FIG. 8 is an explanatory view schematically showing the bending apparatus disclosed in Patent Document 1.

FIGS. 7(*a*)-7(*c*) are explanatory views showing examples of hollow members 22*a* -22 *c* according to the present invention. FIGS. 7(*a*) and 7(*c*) show the case in which the outer shape is generally straight over its entirety, and FIG. 7(*b*) shows the case in which the outer shape has a curved shape with a large radius of curvature over its entirety.

The hollow members 22*a*-22*c* have hollow steel bodies 23*a*-23*c*. The bodies 23*a*-23*c* are each constituted by a single unitary part in the lengthwise direction having a closed transverse cross-sectional shape.

The bodies 23*a*-23*c* each have at least a first region 24 and a second region 25 in the lengthwise direction. The transverse cross-sectional shape of the bodies 23*a*-23*c* in the first region 24 is different from the transverse cross-sectional shape of the bodies 23*a*-23*c* in the second region 25.

Over all or a portion thereof of the lengths thereof, the hollow members 22*a*-22*c* have an extremely high strength of at least 780 MPa which could not be obtained by the hydroforming disclosed by Non-Patent Document 1, for example.

The hollow member 22 can be applied to uses such as the following (i)-(vii):

(i) a strength member for an automobile such as a lower arm of a suspension or a brake pedal;

(ii) reinforcing members such as all types of reinforcement and braces for automobiles;

(iii) structural parts of automobiles such as bumpers, door impact beams, side members, suspension mount members, pillars, and side sills;

(iv) frames and cranks for bicycles, motorcycles, or the like;

(v) reinforcing members for vehicles such as railway cars and components of bogies (bogie frames, all types of beams, and the like);

(vi) framing and reinforcing members for ship hulls and the like; and (vii) strength members, reinforcing members, and structural members for household electric appliances.

The invention claimed is:

1. A method of manufacturing a hollow member having a hollow metal body which has a closed transverse cross-sectional shape and which is constituted by a single piece in a lengthwise direction, and characterized in that the hollow metal body has at least a first region and a second region in the lengthwise direction, and in that the transverse cross-sectional shape of the hollow metal body in the first region is different from the transverse cross-sectional shape of the hollow metal body in the second region, the method comprising:

supporting a hollow metal material being worked having a closed transverse cross-sectional shape at a first position while feeding it in its lengthwise direction, heating the material being worked at a second position downstream of the first position in the feed direction of the material being worked, carrying out working of the heated material in the feed direction of the material, at a third position downstream of the second position, the working modifying the transverse cross sectional shape of the material along a length of the material being worked to produce the hollow member after completion of working that has a transverse cross-sectional shape that changes along a length of the hollow member, cooling the worked material at a fourth position downstream of the third position in the feed direction of the material being worked, and carrying out bending of the material being worked by moving a mechanism that grips the material being worked downstream of the fourth position in the feed direction of the material being worked two dimensionally or three dimensionally.

2. The method of manufacturing a hollow member as set forth in claim 1 including applying a tensile force or a compressive force to the material being worked between the second position and the third position by modifying the feed speed of the material being worked on the entry side of the first position and/or modifying the speed of passage of the material being worked at the third position.

3. The method of manufacturing a hollow member as set forth in claim 1 including locally heating the material being worked in the lengthwise direction of the material being worked at the second position, and carrying out working which modifies the transverse cross-sectional shape of at least part of the unheated portion of the material being worked.

4. The method of manufacturing a hollow member as set forth in claim 2 including locally heating the material being worked in the lengthwise direction of the material being worked at the second position, and carrying out working which modifies the transverse cross-sectional shape of at least part of the unheated portion of the material being worked at the third position.

5. The method of manufacturing a hollow member as set forth in claim 1, wherein the carrying out working step which modifies in the feed direction the transverse cross-sectional shape of the material being worked uses at least a pair of rolls movable two-dimensionally or three-dimensionally.

6. The method of manufacturing a hollow member as set forth in claim 1, wherein the carrying out working step which modifies in the feed direction the transverse cross-sectional shape of the material being worked reduces a width or a height, or a thickness of the material.

7. The method of manufacturing a hollow member as set forth in claim 1, wherein the carrying out working step which modifies in the feed direction the transverse cross-sectional shape of the material being worked uses a pair of rolls, one of which is a driven roll.

* * * * *